US006210492B1

(12) United States Patent
Wilson, III

(10) Patent No.: US 6,210,492 B1
(45) Date of Patent: Apr. 3, 2001

(54) CLEANING SOLUTION SPRAYING SYSTEM AND METHOD

(76) Inventor: Lewis B. Wilson, III, 3317 Rue De Lafitte, Tallahassee, FL (US) 32312

( * ) Notice: Subject to any disclaimer, the term of this patent is extended or adjusted under 35 U.S.C. 154(b) by 0 days.

(21) Appl. No.: 09/264,556

(22) Filed: Mar. 8, 1999

(51) Int. Cl.[7] ..... B08B 3/02
(52) U.S. Cl. ..... 134/18; 134/34
(58) Field of Search ..... 134/18, 34, 42

(56) References Cited

U.S. PATENT DOCUMENTS

| | | | |
|---|---|---|---|
| 3,680,786 | 8/1972 | Levy | 239/146 |
| 4,553,702 | 11/1985 | Coffee et al. | 239/690 |
| 4,597,720 | 7/1986 | Friedrichs | 417/368 |
| 4,725,004 | 2/1988 | Baran, Jr. | 239/164 |
| 5,230,471 | 7/1993 | Berfield | 239/124 |
| 5,299,767 | 4/1994 | Simpson | 248/129 |
| 5,626,291 | 5/1997 | Flinn et al. | 239/310 |
| 5,643,476 * | 7/1997 | Garmire et al. | 219/121.68 |
| 5,706,548 | 1/1998 | Schabacker | 15/322 |

* cited by examiner

*Primary Examiner*—Philip R. Coe
(74) *Attorney, Agent, or Firm*—Peter Loffler

(57) ABSTRACT

A cleaning solution spraying system has a base onto which one or two tanks are secured, one of the tanks having a cleaning solution and the other tank having water. The tanks are each connected to a pump and each pump is connected to a T-fitting with the T-fitting also connected to a nozzle. If only the solution tank is used, the T-fitting is connected directly to a pressurized fluid source such as an ordinary faucet with a pressure gauge assuring a constant amount of pressure flowing to the respective pump and a gauge allowing a user to ascertain the incoming pressure. A second T-fitting allows the use of two tanks and a direct connection to the source of pressurized fluid. A manifold system is connected to the solution tank to regulate the amount of cleaning solution used, the manifold having a plurality of valve-laden feeder tubes that allow a user to regulate the amount of fluid flowing therethrough.

3 Claims, 4 Drawing Sheets

CLEANING SOLUTION SPRAYING SYSTEM AND METHOD

BACKGROUND OF THE INVENTION

1. Field of the Invention

The present invention relates to a vehicle-based cleaning solution spraying system and method for cleaning buildings, signs roadways, and the like.

2. Background of the Prior Art

Devices that wash buildings, roadways and driveways, signs, and the like are known in the art. These devices work on various principles and with various levels of efficiency and productivity, however, they each suffer from one or more drawbacks.

Many devices are relatively small and are unable to effectively clean a relatively large structure such as a commercial building. Others are relatively complex in design and construction, resulting in relatively high acquisition and maintenance costs that make such devices prohibitive to use. Some devices lack sufficient controls to achieve delivery of a cleaning solution having a desired concentration and a desired discharge pressure.

Therefore, there is a need in the art for a cleaning solution spraying system that can be used in commercial settings yet that is of relatively simple design and construction and is relatively easy to use. Such a device must have adequate controls to allow delivery of a desired solution concentration at a desired discharge pressure.

SUMMARY OF THE INVENTION

The cleaning solution spraying system of the present invention addresses the aforementioned needs in the art. The device, which can be effectively used in a commercial setting, delivers a cleaning solution of a desired concentration at a desired discharge pressure. This discharge pressure control allows the cleaning solution spraying system to be operated in a low pressure mode such as when the cleaning solution is being sprayed onto the structure and a high pressure mode such as during the rinse phase. The device is of relatively simple design and construction and is relatively easy to use.

The cleaning solution spraying system of the present invention is comprised of a base, a first tank and possibly a second tank secured to the base. A first T-fitting fluid flow connects the two tanks with a nozzle. A first pump, a first valve, and a first check valve are fluid flow disposed between the first T-fitting and the first tank while a second pump, a second valve, and a second check valve are fluid flow disposed between the first T-fitting and the second tank. Appropriate filters are disposed within the system. A second T-fitting can be fluid flow connected to the first tank, the first pump and a water source such as an ordinary water faucet. A pressure regulator and a pressure gauge are fluid flow disposed between the second T-fitting and the water source. The first tank can be omitted and the first T-fitting can be fluid flow connected directly to the water source. A manifold system is fluid flow disposed between the first T-fitting and the first pump for regulating the amount of fluid flowing therefrom during the cleaning solution spraying process. The manifold comprises an inlet port fluid flow connected to the first pump, an outlet port fluid flow connected to the first T-fitting, and a plurality of feeder tubes, each feeder tube fluid flow connected to the inlet port and to the outlet port, and at least some of the feeder tubes having a valve of any appropriate type. In order to control the pressure of the fluid at the outlet port, an appropriate number of valves on the feeder tubes are opened. For a relatively low pressure, a relatively small number of valves are opened, for a relatively high pressure, a relatively large number of valves are opened. A variable rate control valve and a pressure gauge are fluid flow disposed between the first T-fitting and the nozzle for regulating and monitoring the discharge pressure of the fluid at the nozzle.

The cleaning solution spraying system of the present invention can be mounted on a vehicle, either a towable trailer or directly onto a vehicle capable of self-locomotion, such as a truck. Such mounting is ideally suited for use by government entities and others in cleaning and tracking roadway signs. Specifically, an operator may take the cleaning solution spraying system to a sign and using a ground positioning system (GPS) receiver, obtain the GPS location coordinates of the sign. These location coordinates can then be entered into an entry within a database, the database having a data structure with one of its data elements being a location data element, and optionally, a sign type data element, and a date data element. The sign type data and the date data are also entered. Once the operator cleans the sign and enters the data, the operator moves on to the next sign and repeats the process. Once all the signs within a given area are cleaned, the locations and cleaning status of the signs will be accurately known to the responsible entity, thereby allowing tracking of the signs within the area.

BRIEF DESCRIPTION OF THE DRAWINGS

Similar reference numerals refer to similar parts throughout the several views of the drawings.

DESCRIPTION OF THE PREFERRED EMBODIMENT

Figure 1:
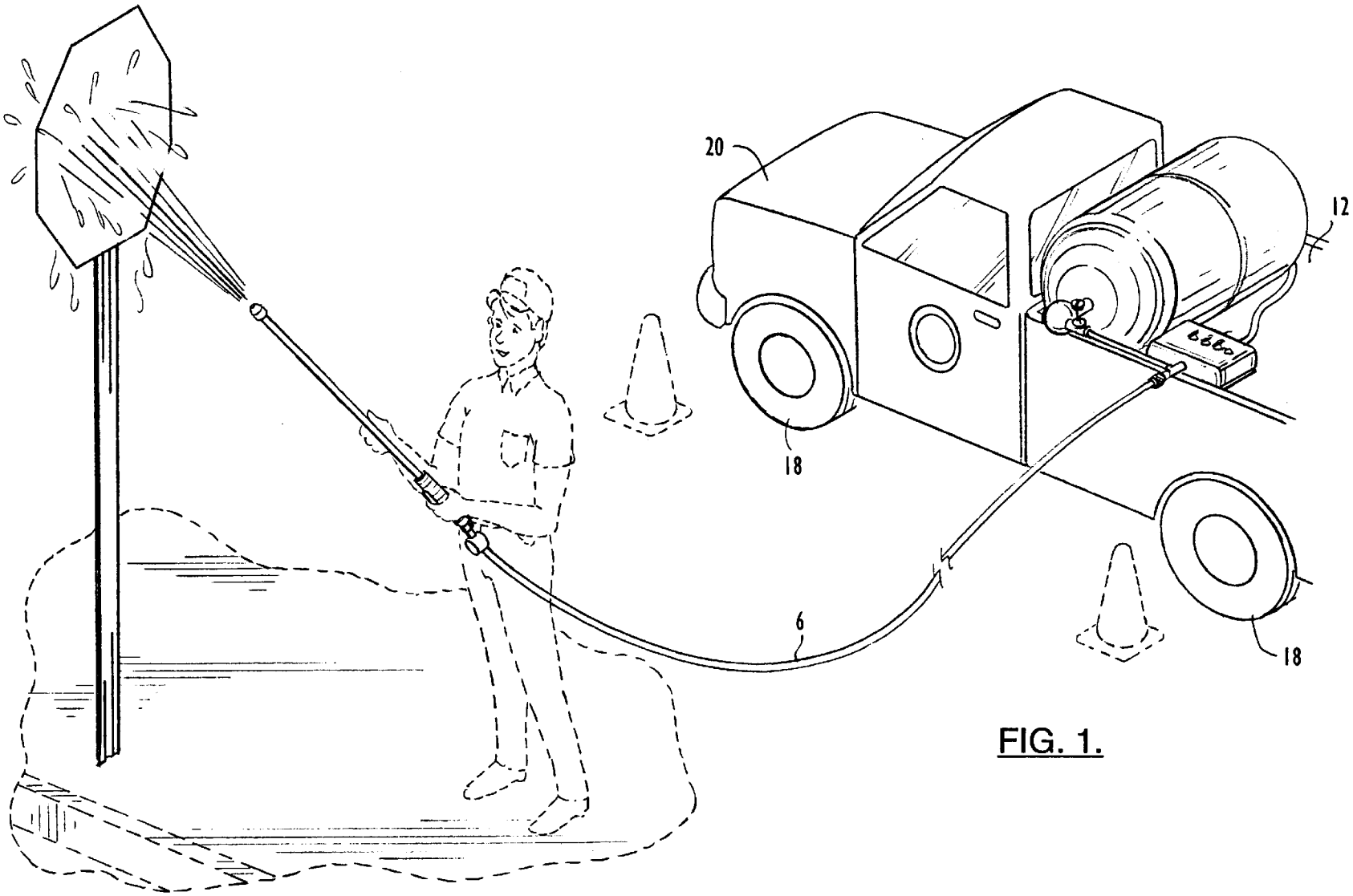
FIG. 1 is a perspective view of the cleaning solution spraying system of the present invention being used to clean a sign.
Figure 2:
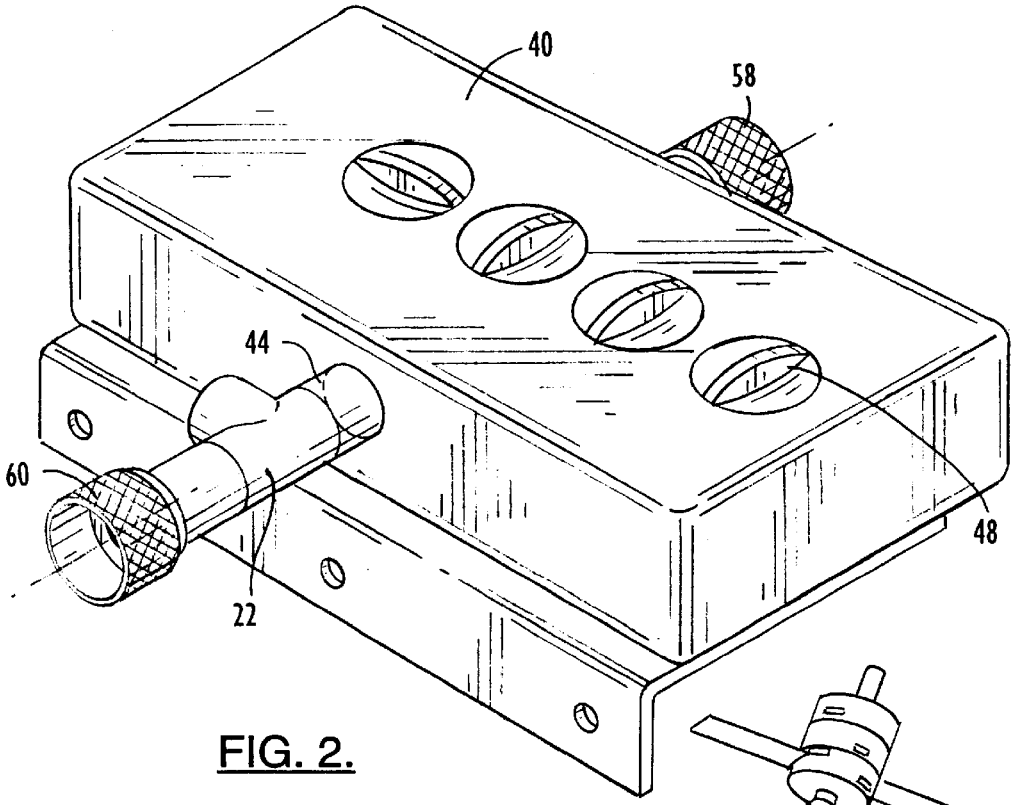
FIG. 2 is a perspective view of the manifold used with the cleaning solution spraying system of the present invention.
Figure 3:
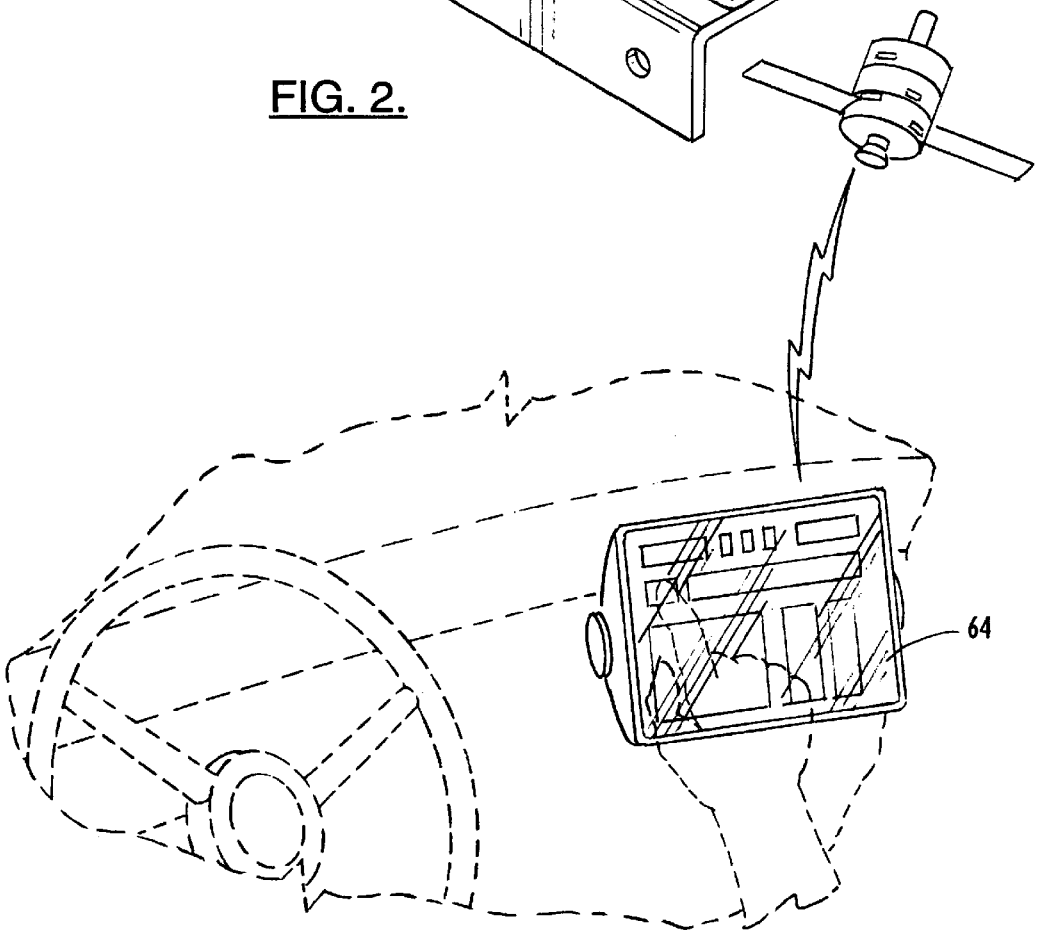
FIG. 3 is a perspective view of a GPS receiver used with the method of the present invention.
Figure 4:
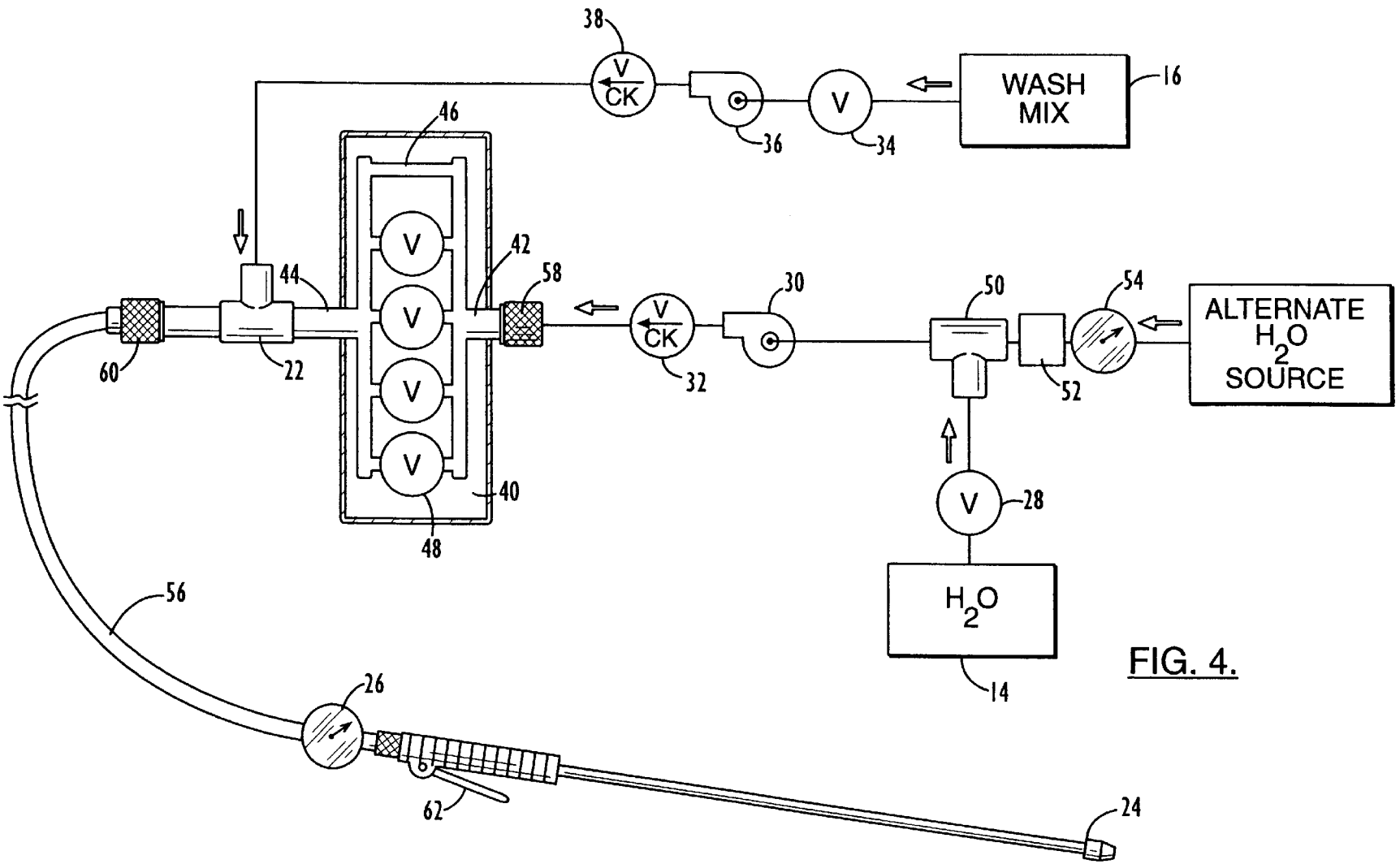
FIG. 4 is a schematic view of plumbing system of the cleaning solution spraying system of the present invention.
Figure 5:
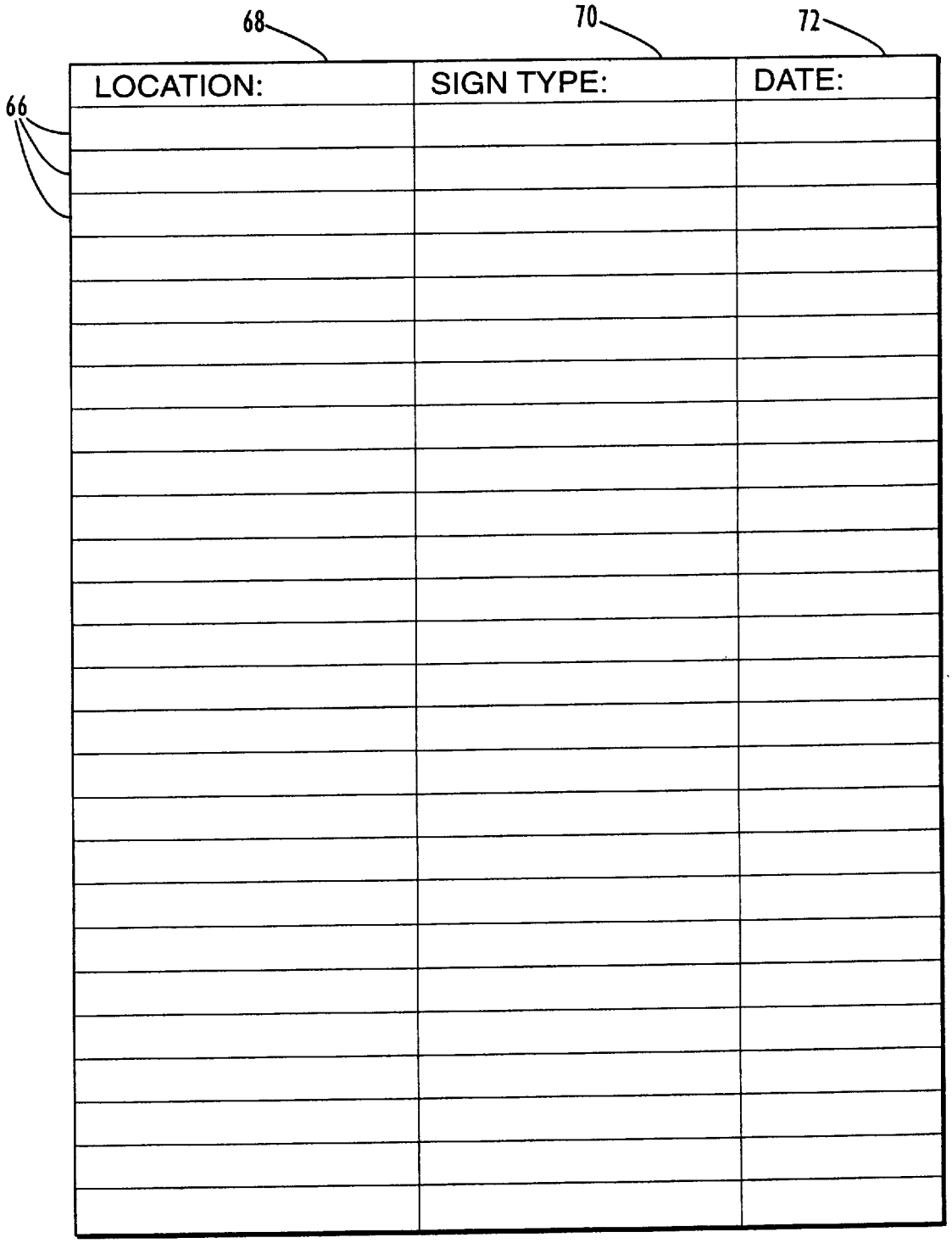
FIG. 5 illustrates the database used with the method of the present invention.

Referring now to the drawings, it is seen that the cleaning solution spraying system of the present invention is comprised of a base 12, having a first tank 14 for holding water, and a second tank 16 for holding a desired cleaning fluid. The base 12 may have wheels 18 allowing it to be towed and may have several accessories for assisting in the cleaning solution spraying process, such as hose reels, electric cord reels, an electrical generator or other power source such as an electric cord and plug, a ladder holder, storage hooks, etc., (none illustrated). Additionally, the base 12 may be part of a self-locomotion vehicle such as being part of the bed of a truck 20.

A first T-fitting 22 is fluid flow connected to the first tank 14, to the second tank 16 and to a nozzle 24. A first pressure gauge 26 is fluid flow disposed between the nozzle 24 and the first T-fitting 22. A first valve 28 is fluid flow connected to the first tank 14, a first pump 30 is fluid flow connected to the first valve 28, and a first check valve 32 is fluid flow disposed between the first pump 30 and the first T-fitting 22. A second valve 34 is fluid flow connected to the second tank 16, a second pump 36 is fluid flow connected to the second valve 34, and a second check valve 38 is fluid flow disposed between the second pump 36 and the first T-fitting 22. A manifold 40 is fluid flow disposed between the first T-fitting 22 and the first pump 30 (the first check valve 32 can be on either side of the manifold 40). The manifold 40 has an inlet port 42 that is fluid flow connected to the first pump 30, an outlet port 44 that is fluid flow connected to the first T-fitting 22, and a plurality of feeder tubes 46, each feeder tube 46 fluid flow connected to the inlet port 42 and to the outlet port 44, and at least some of the feeder tubes 46 having a valve 48 of any appropriate type. A second T-fitting 50 can be fluid flow connected to the first pump 30, to the first tank 14, and to the a water source W. A pressure regulator 52 is fluid flow disposed between the second T-fitting 50 and the water source W and a second pressure gauge 54 is fluid flow disposed between the second T-fitting 50 and the pressure regulator 52 (or between the pressure regulator 52 and the water source W). Alternately, the first tank 14 can be eliminated such that the first T-fitting 22 is fluid flow connected only to the water source W via the pressure regulator 52 and the second pressure gauge 54 and optionally the first pump 30. All fluid flow connections are made using standard hoses and pipes 56 and couplings 58, and, advantageously, the nozzle 24 is connected to the first T-fitting 22 via a quick connect fitting 60 so that the nozzle 24 can be quickly coupled to the system 10 at job startup and quickly disconnected for storage after job completion.

Appropriate filters (not illustrated) are disposed at appropriate locations within the system 10.

In order to use the cleaning solution spraying system 10 of the present invention, an appropriate cleaning fluid is put into the second tank 16 and, if used, water is placed into the first tank 14. If the first tank 14 is not used, the first pump 30 is connected to a water source W. The nozzle 24 is connected to the first T-fitting 22 (if not already so connected). An appropriate amount of feeder tube valves 48 are opened, the higher the desired pressure of water entering the first T-fitting 22, the more feeder tube valves 48 that are opened. This controls the concentration of the discharged cleaning solution in that at a higher water pressure, more water enters the first T-fitting 22 for a given amount of cleaning fluid entering the first T-fitting 22 from the second tank 16, and thus the lower the concentration of the solution at discharge. The first valve 28 and the second valve 34 are each opened and the first pump 30 and the second pump 36 are each activated. The first pump 30 pumps water to the nozzle 24 from either the first tank 14 or the water source W and the second pump 36 pumps the cleaning solution to the nozzle 24 from the second tank 16. An operator uses the nozzle 24 to spray the combined solution onto a desired surface. An appropriate variable rate control valve 62, having a variable rate of fluid discharge, is located on the nozzle 24 and allows the operator to control the rate of solution discharge. In the illustrated squeeze lever control valve 62, the more the operator squeezes the lever, the higher the pressure of the discharged solution. The first pressure gauge 26 allows the operator to monitor the pressure at the nozzle 24. If the first pump 30 is connected to the water source W, the pressure regulator 52 assures that the water entering the first pump 30 does not exceed a certain maximum pressure. The second pressure gauge 54 allows the operator to assure that at least a minimum required pressure of water is going to the first T-fitting 22.

In the operator needs to rinse the desired surface, the second valve 34 is closed and the second pump 36 is deactivated. The second check valve 38 assures that no solution back flows to the second tank 16. As only water from the first tank 14 or from the water source W is now entering the nozzle 24, the operator can now rinse the desired surface. After job completion, the first valve 28 is closed and the first pump 30 is deactivated. The first check valve 32 assures that no back flow of solution or water occurs. If so attached, the first pump 30 is disconnected from the of water source W.

If the first tank 14 is used, the second T-fitting 50 can be connected to the water source W. The first valve 28 is opened and the first pump 30 remains inactive. The water entering the system 10 from the water source W is routed into the first tank 14, thereby filling the first tank 14.

The cleaning solution spraying system 10 ideally and uniquely lends itself for use by government entities and others in cleaning and tracking roadway signs S. Specifically, an operator may take the cleaning solution spraying system 10 to a sign S, and using a standard ground positioning system (GPS) receiver 64, obtain the GPS location coordinates of the sign S. These location coordinates can then be entered into an entry 66 of the database, the database having a data structure with one of its data elements being a location data element 68, and optionally, a sign type data element 70, and a date data element 72, as well as any other desired data elements. The sign type data and the date data are also entered into the database. Once the operator cleans the sign S and enters the data, the operator moves on to the next sign S and repeats the process. Once all the signs S within a given area are cleaned, the locations of the signs S will be accurately known to the responsible entity, thereby allowing tracking of the signs S within the area. This permits very efficient cleaning and location warehousing of an entity's signs S.

While the invention has been particularly shown and described with reference to embodiments thereof, it will be appreciated by those skilled in the art that various changes in form and detail may be made without departing from the spirit and scope of the invention.

What is claimed is:

1. A method for cleaning and tracking signs comprising the steps of:

providing a vehicle;

providing a cleaning solution spraying system connected to the vehicle;

providing a GPS receiver;

providing a database having a data structure with a location data element and a plurality of entries;

moving the vehicle to a sign;

retrieving location data from the GPS receiver;

cleaning the sign using the cleaning solution spraying system; and entering the location data into a location data element within a respective one of the plurality of entries.

2. The method as in claim 1 further comprising:

providing a sign type data element within the data structure of the data base; and entering the sign type into the sign type data element within the respective one of the plurality of entries.

3. The method as in claim 1 further comprising:

providing a date data element within the data structure of the data base; and entering the date into the date data element within the respective one of the plurality of entries.

* * * * *